United States Patent [19]

Gaiardo

[11] Patent Number: 4,810,112

[45] Date of Patent: Mar. 7, 1989

[54] DOT MATRIX PRINT HEAD OF IMPROVED TYPE

[75] Inventor: Mario Gaiardo, Ivrea, Italy

[73] Assignee: Microlys S.p.A., Turin, Italy

[21] Appl. No.: 69,986

[22] Filed: Jul. 6, 1987

[30] Foreign Application Priority Data

Jul. 25, 1986 [IT] Italy ..... 53691/86[U]

[51] Int. Cl.[4] ..... B41J 3/12

[52] U.S. Cl. ..... 400/124; 101/93.05

[58] Field of Search ..... 400/124; 101/93.05; 335/270, 275, 278

[56] References Cited

U.S. PATENT DOCUMENTS

| | | | |
|---|---|---|---|
| 4,009,772 | 3/1977 | Glaser | 101/93.05 X |
| 4,033,255 | 7/1977 | Kleist | 101/93.04 |
| 4,375,338 | 3/1983 | Mitsuishi | 400/124 |
| 4,407,591 | 10/1983 | Adamoli | 400/124 |
| 4,518,269 | 5/1985 | Akazawa | 400/124 |
| 4,600,321 | 7/1986 | Kwan | 400/124 |
| 4,647,236 | 3/1987 | Moriya | 400/124 |
| 4,697,939 | 10/1987 | Ara | 400/124 |

*Primary Examiner*—Paul T. Sewell

*Attorney, Agent, or Firm*—Omri M. Behr

[57] ABSTRACT

A dot matrix print head of improved type is described the principal characteristic of which lies in the fact that the casing containing the electromagnets actuating the needles is clamped between the needle support body and a cover carrying on its interior the striker elements which, when attracted by the electromagnets, displace the needles; the casing is formed by an extruded metal tube body and by an element of plastics material between which are inserted, in appropriate grooves, stacks of U-shape laminations carrying at one end respective electrical windings constituting the electromagnets.

7 Claims, 1 Drawing Sheet

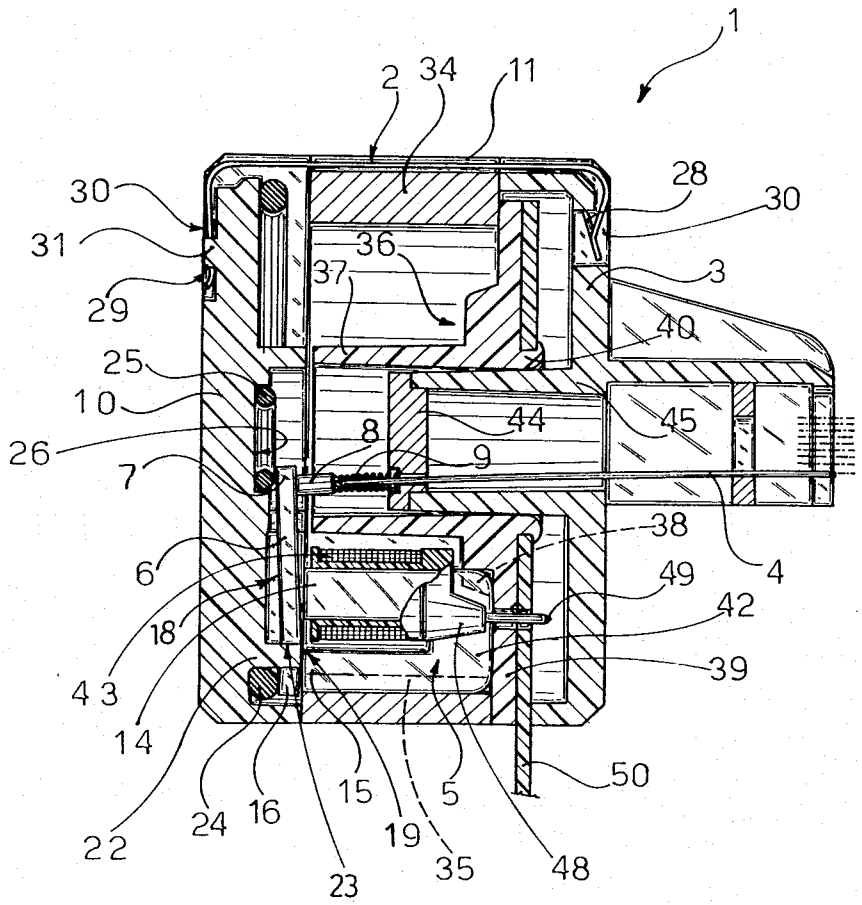
1
2
3
4
5
6
7
8
9
10
11
14
15
16
18
19
22
23
24
25
26
28
29
30
30
31
34
35
36
37
38
39
40
42
43
44
45
48
49
50

DOT MATRIX PRINT HEAD OF IMPROVED TYPE

BACKGROUND OF THE INVENTION

The present invention relates to a dot matrix print head of improved type, having a structure able to facilitate its construction and assembly.

It is known that in dot matrix print heads the needles, slidably supported by an appropriate body, are projected against a surface to be printed, where they leave marks forming the print characters, due to the impact of ferromagnetic elements, the said blades, which are attracted towards the heads of the needles to be actuated by respective electromagnets, and against the action of resilient biasing means. This actuating system involves a not inconsiderable constructional complexity of the heads which keeps their cost high and makes assembly difficult and, in general, increases the dimensions thereof with respect to the theoretical limit.

SUMMARY OF THE INVENTION

The object of the invention is that of providing a dot matrix print head of the type described above, but having an increased ease of assembly and construction as well as reduced dimensions and high efficiency.

The said object is achieved by the invention, which relates to a dot matrix print head of improved type, comprising a support body slidably carrying a plurality of print needles, a casing housing within it a plurality of electromagnets for actuating the said needles and a rear closure cover for the said casing carrying on its inner side, a plurality of striker elements for the said print needles mounted rockably between the said cover and the said electromagnets and able to be attracted towards these latter, against the action of biasing means, to strike the said needles and consequently produce translation thereof, characterised by the fact that the said casing is clamped between the said cover and the said needle support body, which constitutes an element independent thereof, and includes an outer carrier element constituted by a cylindrical tube body internally provided with respective longitudinal first grooves, and an inner carrier element including a central tubular portion disposed substantially coaxially with the said tube body and provided with a plurality of second longitudinal grooves facing corresponding said first grooves of this latter, and a flange portion extending peripherally, perpendicular to the said tubular portion, from one end of this latter and fixed as a closure to the said tube body on the needle support body side; between each pair of said first and second grooves there being fitted a respective said electromagnet which comprises a stack of U-shape adjacent laminations made of ferromagnetic material on one of the two opposite ends of which is mounted an electric winding; and the said needles being housed passing through the said central tubular portion of the inner carrier element.

BRIEF DESCRIPTION OF THE DRAWING

For a better understanding of the invention a non-limitative description of an embodiment is now given, making reference to the attached drawing in which is illustrated a longitudinal side view sectioned alongs its axis of a print head formed according to the principles of the invention and generally indicated with the reference numeral 1.

DETAILED DESCRIPTION OF THE INVENTION

The print head 1 comprises a casing 2 closed at the front by an elongate support body 3 constituting an element independent from the casing 2 and slidably carrying a plurality of print needles 4 only one of which is illustrated for simplicity, respective U-shape actuating electromagnets 5 for the needles 4, housed in such a way that they are directed towards the interior of the casing 2, and a plurality of striker elements or blades 6 corresponding in number to that of the electromagnets 5 and needles 4, made in a ferromagnetic material and able to be attracted by respective electromagnets 5 to strike with their respective ends 7 respective heads 8 of the needles 4 in such a way as to cause translation of these latter against the action of respective springs 9 and consequent impacts thereof on the surface to be printed. The striker or blade elements 6, only one of which is illustrated for simplicity, are disposed in a ring and are carried in the manner of spokes by a plug or circular cover 10 of known type which closes the casing 2 from the rear and which is fixed rigidly to this latter and, consequently, to the body or support element 3 for the needles 4, by connection means 11. Each electromagnet 5 has a pair of respective opposite ends defining respective adjacently disposed poles of opposite sign, indicated respectively 14 and 15; the electromagnets 5 are also disposed in a ring within the casing 2 in such a way that the poles 14 are disposed closer to the axis of symmetry of the head 1 than the poles 15, or rather they are located radially inwardly of these latter. The striker or blade elements 6 which are disposed opposite the pair of adjacent poles 14 and 15 of respective electromagnets 5 have a second end 16 opposite the end 7, through which they are rockably supported in a resilient manner in correspondence with the respective pole 15 of each electromagnet 7 by means carried by the plug 10, and an intermediate portion 18 immediately adjacent the ends 16, in correspondence with which they are rockably supported or rather free to oscillate perpendicular to the plane of the plug 10, on a fulcrum constituted by an edge 19 of a flat front surface delimiting the respective pole 15; the said resilient support means of the end 16 consist of a respective pin 22, one for each element 6, formed integrally with and projecting perpendicularly from the plug 10 on the inner side of this and housed with a clearance within the interior of a hole 23 formed through the end 16 immediately adjacent the intermediate portion 18, and an elastomeric biasing element common to all the elements 6, constituted by a seal or toroidal ring 24 of natural or synthetic rubber of the "O-ring" type, disposed immediately behind the end 16 between this and the bottom wall of the plug 10 in such a way as to oppose separation of the end 16 itself from the pole 15 following a rotation of the element 6 on the corner 19 towards the pole 14. On the end 7 of each element 6 there also acts a further resilient biasing element constituted by a seal or ring 25 of the same type as the ring 24 carried by the plug 10 concentrically of the ring 24 itself within a recess 26.

According to the invention the casing 2 is clamped between the body 3 and the cover 10, which closes it to the rear, by means 11 which preferably consist of respective U-shape springs fitted onto these from the side and provided with snap-engagement coupling means defined by respective tongues 28 and holes 29 which can engage with respective seats 30 and pins 31 formed peripherally in the support body and in the cover; the casing 2 includes an outer carrier element constituted by a cylindrical body 34 of extruded metal tube provided internally with respective longitudinal grooves 35, and an inner carrier element 36 made of synthetic plastics material, comprising a central tubular portion 37 disposed substantially coaxially with the tube body 34 and provided with a plurality of longitudinal grooves 38 facing corresponding grooves 35, and a flange portion 39 extending peripherally perpendicular to the tubular portion 37 from one end 40 of this latter and fixed to close the tube body 34 from the side of the body 3 with any convenient means, for example by glueing or, preferably, by snap-engaging pins of any known type not illustrated for simplicity; between each pair of grooves 35 and 38 is fitted a respective electromagnet 5, which comprises a stack 42 of U-shape adjacent ferromagnetic laminations on one of the two opposite ends of which is mounted an electric winding 43.

The needles 4 are housed passing through the central tubular portion 37 within a guide matrix 44 of known type supported by a tubular projection 45 of the body 3. According to the invention a first of the lateral arms of the stack of laminations 42 of each electromagnet 5 defining the pole 14 is inserted in a respective groove 38, whilst the other arm, defining the pole 15, is inserted in the associated groove 35 facing it and carries the winding 43 fitted thereto. This is incorporated in an annular support 48 of plastics material provided with a connector 49 by means of which the winding and the associated support are fixed, through suitable holes, to the flange portion 39 and to a printed circuit 50 fixed rigidly to this latter on the side of the body 3, for example by glueing or by pins not illustrated for simplicity. According to the invention, finally, the end or pole 14 of the electromagnets 5 have a width, in a radial sense with respect to the axis of the metal tube body 34, greater than that of the end or pole 15 thereof, which improves the performance of the electromagnetic actuating device.

From what has been described the advantages connected with the head formed according to the invention will be evident; thanks to the described structure the casing can be obtained in an economic manner from extruded tubes and assembly of the electromagnets is facilitated; the form of these and the system for coupling to the blades then increases the efficiency of the head and permits the electromagnetic control system to be made in a modular form which reduces the cost of production very greatly. Finally, with the described structure the dimensions are reduced to the minimum possible.

I claim:

1. A dot matrix print head of improved type, comprising:

a support body slidably carrying a plurality of print needles, a casing housing within it a plurality of electromagnets for actuating the said needles, and a rear closure cover for the said casing, carrying on its inner side a plurality of striker elements for the said print needles, mounted rockably between the said cover and the said electromagnets and able to be attracted towards these latter, against the action of biasing means, to strike the said needles and consequently produce translation thereof, characterised by the fact that the said casing is clamped between the said cover and the said needle support body, which constitutes an element independent thereof, and includes:

(a) an outer carrier element constituted by a cylindrical tube body provided internally with respective first longitudinal grooves, and (b) an inner carrier element including: (i) a central tubular portion disposed substantially coaxially within the said tube body to form therebetween an annular space, said central tubular portion being provided with a plurality of second longitudinal grooves facing corresponding said first grooves of this latter, and (ii) a flange portion extending peripherally, perpendicular to the said tubular portion, from one end of this latter and fixed as a closure to the said tube body on the needle support body side;

between each pair of said first and second grooves there being fitted a respective said electromagnet which comprises a stack of U-shape adjacent laminations made of ferromagnetic material on one of the two opposite ends of which is mounted an electric winding; and the said needles being housed passing through the said central tubular portion of the inner carrier element.

2. A print head according to claim 1, characterized by the fact that the said outer carrier element is constituted by an extruded metal tube body, whilst the said inner carrier element is made, in combination, in a moulded synthetic plastics material.

3. A print head according to claim 1, characterised by the fact that the said striker elements are fixed to the said cover by means of respective pins rigidly connected to this latter, which engage with clearance in respective through holes formed through the striker elements; and by the fact that the striker elements cooperate with and contact first ends of the said electromagnets, constituted by one of the arms of the said stack of U-shape laminations, which are inserted into the said first grooves and define first poles of the electromagnets; a second end of these latter, constituted by the other arm of the said stack of U-shape laminations and which defines a second pole thereof disposed adjacent the first pole and towards which the said striker elements can be attracted being inserted into the said second grooves and carrying the said electric winding fitted thereto.

4. A print head according to claim 3, characterised by the fact that the said second end of the said electromagnets have, in a radial sense with respect to the axis of the said tube body, a greater width than that of the said first ends thereof.

5. A print head according to claim 3, characterised by the fact that the said biasing means comprise a pair of toroidal elastomeric rings carried concentrically by the said cover and cooperating by abutment with the respective opposite ends of the said striker elements which are disposed in the manner of spokes on the cover, each opposite the side-by-side opposite poles of a respective electromagnet.

6. A print head according to claim 1, characterised by the fact that the said electrical winding of each electromagnet is mounted on an annular support of plastics material provided with a connector by means of which the winding and the associated support are fixed to the said flange portion of the inner carrier elements and to the printed circuit fixed rigidly to this latter on the needle support body side thereof.

7. A print head according to claim 1, characterised by the fact that the said casing, cover and support body for the needles are fixed rigidly together one against the other by means of respective U-shape springs fitted from the side thereof and provided with snap-engaging means operable to engage with respective seats formed peripherally in the support body and in the cover.

* * * * *